United States Patent [19]

Bianchi et al.

[11] 3,982,574

[45] Sept. 28, 1976

[54] FLEXIBLE PORTABLE DISPENSING CONTAINER

[76] Inventors: Rodolfo Edmundo Bianchi; Olga Beatriz Ueltschi De Bianchi, both of 233 Sobremonte Street, San Rafael (Mendoza), Argentina

[22] Filed: May 7, 1975

[21] Appl. No.: 575,235

[52] U.S. Cl. ..... 150/9

[51] Int. Cl.$^2$ ..... B65D 31/14

[58] Field of Search ..... 150/3, 7, 8, 9; 229/62, 229/62.5

[56] References Cited

UNITED STATES PATENTS

| | | | |
|---|---|---|---|
| 1,089,279 | 3/1914 | Simer | 150/9 |
| 2,665,033 | 1/1954 | Robertson | 229/62.5 X |
| 2,998,340 | 8/1961 | Conway | 229/62.5 UX |
| 3,142,436 | 7/1964 | Heigl | 229/62 |
| 3,224,640 | 12/1965 | Schneider | 229/62 X |
| 3,339,825 | 9/1967 | Grevich | 150/3 X |
| 3,537,456 | 11/1970 | Harautunean | 150/8 X |
| 3,720,367 | 3/1973 | Rayner | 150/7 X |

FOREIGN PATENTS OR APPLICATIONS

| | | | |
|---|---|---|---|
| 113,194 | 2/1969 | Denmark | 229/62.5 |
| 670,326 | 10/1964 | Italy | 229/62.5 |
| 423,018 | 7/1947 | Italy | 229/65 |

*Primary Examiner*—Donald F. Norton

*Attorney, Agent, or Firm*—Stevens, Davis, Miller & Mosher

[57] ABSTRACT

A flexible portable dispensing container made from a bag of tubular heat-sealable material sealed at the bottom. A handle is added as a welded insert. The handle has a pocket. The upper part of the bag communicates with a tube of heat-sealable material which serves as a dispenser and may be folded and kept into a pocket in the handle. An apparatus adapted to make said dispensing container, said apparatus being provided with one cooled plate contiguous to one heated plate, so that the film in contact with the cooled plate is not welded to keep an open communication between the bag and the dispensing tube.

1 Claim, 5 Drawing Figures

FIG. 1
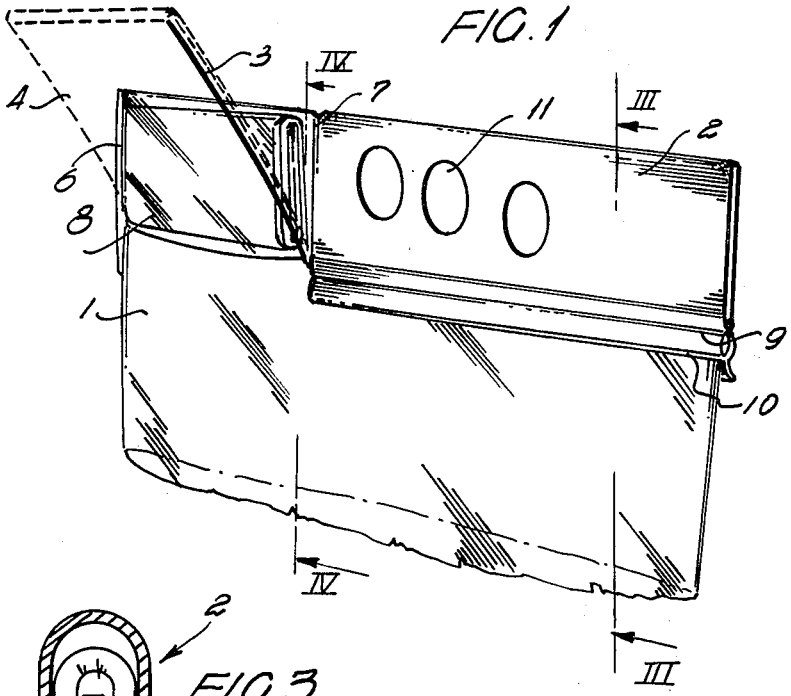
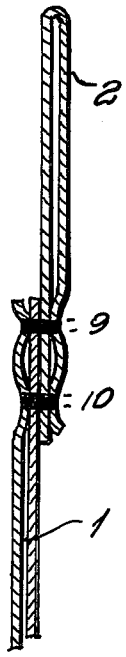
FIG. 2
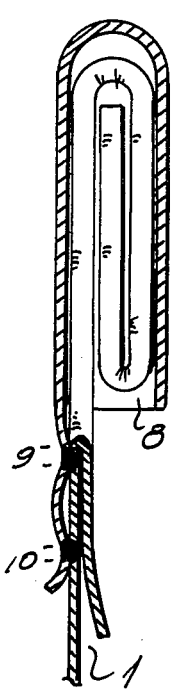
FIG. 3
FIG. 4
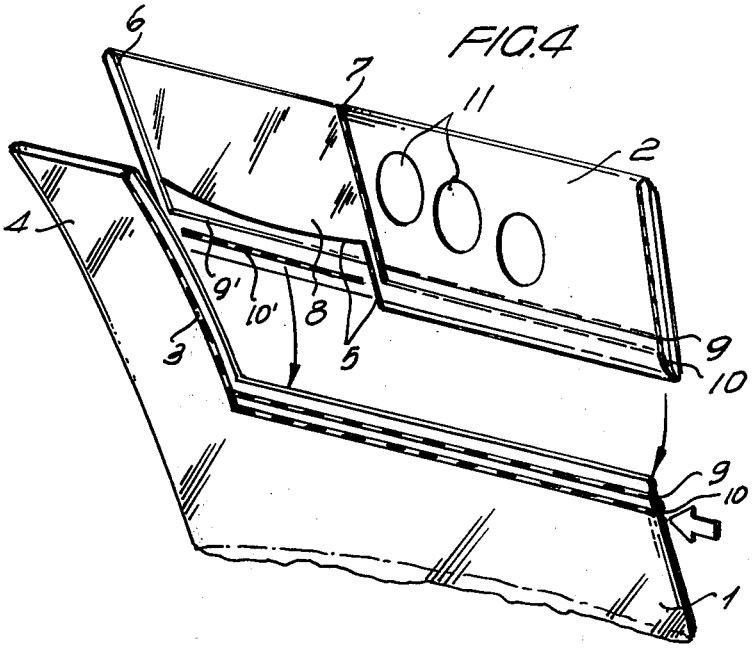
FIG. 5
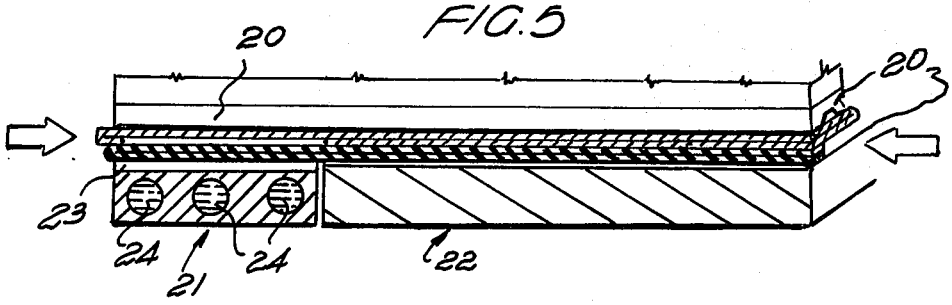

FLEXIBLE PORTABLE DISPENSING CONTAINER

BRIEF SUMMARY OF THE INVENTION

There are two main objects of this invention.

The first one is the attainment of a bag-container that can be shut hermetically; even though it does not have any stopper, it can be shut or open as many times as required by means of a tube integrated to the same container; once finished its mission of filling or emptying the bag-container, it is folded tightly and is kept into an adjacent pocket. This pocket prevents the tube from untwisting and keeps it in the same position up to the moment when it is removed manually.

The second object of this invention is to provide an apparatus by means of which it is possible to weld conveniently a holding flap made of a folded sheet that is juxtaposed to the original mouth of the bag (as this bag is basically made from a flattened tube in extruded plastic).

This sheet at the same time strengthens the handles and provides the pocket where is kept the tube projected from the same bag. The new apparatus allows the welding of the seams of the folded sheet but prevents the welding of the external layer of said tube even though the welding plate operates over all the material.

Summarizing, it comprises a bag, made from a tubular extruded plastic material where its bottom is welded as usual and a parallel sheet folded in two is placed adjacent to it and welded thereto. The sheet has holes therein for passing the finger therethrough to carry it and provides a holding flap, in one side to form a pocket into which the tube may be tightly folded when necessary. The folded sheet welds across the width of the bag. Nevertheless, the part of the tube that corresponds to the opposite side to that where the sheet was added, does not weld.

BRIEF DESCRIPTION OF THE DRAWINGS

FIG. 1 shows a perspective view of the upper part of a container according to this invention, wherein is seen the reinforcement sheet with the holder. The pocket where is kept the folded tube that provides the shutting is also shown through the transparent material. In broken line is shown the referred to tube, unfolded for its use.

FIG. 2 represents a longitudinal section of the folded sheet once added, as per references II—II, shown in FIG. 1.

FIG. 3 represents a longitudinal section of the part of the folded sheet wherein is formed the pocket that keeps the folded tube, as per references III—III, also shown in FIG. 1.

FIG. 4 shows a perspective view of the bag itself, and in an exploded view the holding flap, formed by the folded sheet, separated from the bag. The weldings that join both pieces are also indicated.

FIG. 5 shows a schematic view of the apparatus in which is made the welding of the bag to the holding flap formed by the folded sheet that serves as a handle and also forms a pocket for the dispensing tube.

DETAILED DESCRIPTION

As shown in FIGS. 1 and 4, the container is essentially formed by the plastic bag 1 and the folded sheet 2.

The upper part of the bag 1 is cut in L shape, and this allows to obtain tube 4 by means of welding 3.

By means of a cut 5, a partial piece is taken off of the folded sheet 2 and pocket 8, open from underneath, is obtained when welding sides 6 and 7.

Afterwards is made the cross sectional welding of folded sheet 2, on one of the border sides of bag 1, by means of a process detailed below.

In such a way, weldings 9 and 10, weld the four sheets that form the bag 1 and the holding flap 2 and weldings 9′ and 10′ weld the rear plug of the holding flap 2 and the rear ply of bag 1.

In a bigger scale, FIG. 2 shows how weldings 9 and 10 operate and in the same way in FIG. 3 is shown how weldings 9′ and 10′ operate. In both figures is shown the relation between one and the other pieces and specially in FIG. 3 is shown the tube 4, folded, and introduced into pocket 8.

This performance apparently seems difficult but it is not, thanks to the special apparatus detailed in FIG. 5.

For this purpose it is used a device that, in its upper part, is provided with thermo-welder plate 20, which are those that operate pressing in the usual manner.

The lower plate is provided with sections 21 and 22. Section 22 is normal, that is to say that when the upper plate presses, all the sheets underneath said plates are welded, but this does not happen with section 21. This one is provided in its upper part with a polished plate 23 within section 21, by means of ducts 24, passes a cooling liquid that can be cold water. In this way when plates 20 press the sheets, all of these weld, except the last one. Consequently, for this performance, section 21 should have the exact size of tube 4 and only weld the rear sheet of holding flap 2 (as the front part has been cut) and the rear sheet of bag 1 in the part corresponding to the inner opening of tube 4 as the front sheet rests on the polished and cooled surface. Logically, as the welding plate 20 is of the same width as that of the whole, at one time weld holding flap 2 and bag 1, but tube 4 rests open.

In this way, a flexible container is obtained. It can be filled as many times as needed, can be shut hermetically, can be opened when necessary and can be reinforced to admit a bigger quantity of mobile materials like powder, grains and liquid. The holding flap—having the holes 11 to pass the fingers—will not break easily and will resist thanks to the double material added without much more trouble than that required to add pocket 8.

What is claimed is:

1. Flexible portable dispensing container having a resealable closure, said container comprising an L-shaped bag made from tubular extruded thermoplastic material having transverse heat seal weldings defining the bottom of the bag and the upper portion of the horizontal leg of the L while the sides of the bag are defined by the folds defining the sides of the tubular material and a vertical heat seal welding on the inner side of the vertical leg at the L to form a tube defined by the vertical leg of the L and an insert, said insert comprising a folded foil of a thermoplastic film to form two plies being heat sealed at lower edges to the back of said bag below the upper portion of the horizontal leg of the L to provide an extension in the direction of the tube length, said insert having a cut out of the front ply of a width substantially equal to the width of said tube, said insert having vertical seal weldings on either side of the vertical leg of the L so that a pocket is formed by said two weldings parallel to the tube edges, the back ply of said insert being welded to the back of the tube.

* * * * *